US011121471B2

(12) United States Patent
Forslund

(10) Patent No.: US 11,121,471 B2
(45) Date of Patent: Sep. 14, 2021

(54) DUAL DIRECTIONAL LOG-PERIODIC ANTENNA AND AN ANTENNA ARRANGEMENT

(71) Applicant: SAAB AB, Linkoeping (SE)

(72) Inventor: Ola Forslund, Sundbyberg (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/961,977

(22) PCT Filed: Jan. 18, 2018

(86) PCT No.: PCT/SE2018/050038
§ 371 (c)(1),
(2) Date: Jul. 14, 2020

(87) PCT Pub. No.: WO2019/143275
PCT Pub. Date: Jul. 25, 2019

(65) Prior Publication Data
US 2020/0395669 A1 Dec. 17, 2020

(51) Int. Cl.
*H01Q 11/10* (2006.01)
*H01Q 21/24* (2006.01)

(52) U.S. Cl.
CPC ..... *H01Q 11/10* (2013.01); *H01Q 21/24* (2013.01)

(58) Field of Classification Search
CPC .. H01Q 1/36; H01Q 1/38; H01Q 3/24; H01Q 3/247; H01Q 3/443; H01Q 19/04;
(Continued)

(56) References Cited

U.S. PATENT DOCUMENTS 3,369,243 A * 2/1968 Greiser ..... H01Q 11/10 343/770
4,005,432 A 1/1977 Beccario
(Continued)

FOREIGN PATENT DOCUMENTS

CA 713169 A 7/1965
KR 10-2018-0003515 A 1/2018

OTHER PUBLICATIONS

Charma, S.K., and Shafai, L., "Investigations on Miniaturized Endfire Vertically Polarized Quasi-Fractal Log-Periodic Zigzag Antenna", in IEEE Transactions on Antennas and Propagation, vol. 52, No. 8, Aug. 2004, pp. 1957-1962, IEEE, U.S.
(Continued)

*Primary Examiner* — Andrea Lindgren Baltzell
*Assistant Examiner* — Patrick R Holecek
(74) *Attorney, Agent, or Firm* — Alston & Bird LLP

(57) ABSTRACT

The invention relates to an antenna. The antenna comprises a feed line having first and second ends on opposite sides of the feed line, wherein a transmission axis is defined as the axis extending between the first and second ends of the feed line. Further, the antenna comprises a plurality of antenna elements arranged along the feed line, protruding from the transmission axis. The antenna also comprises a first port at the first end of the feed line, wherein, at a first part of the antenna, the feed line, from the first port towards a reference point along the transmission axis, comprises antenna elements of gradually increasing length, configured to radiate in a first direction along the transmission axis from the reference point towards the first port during excitation in the first port. Yet further, the antenna comprises a second port at the second end of the feed line, wherein, at a second part of the antenna, the feed line, from the second port towards the reference point along the transmission axis, comprises antenna elements of gradually increasing length, configured
(Continued)

to radiate in a second direction along the transmission axis from the reference point towards the second port during excitation in the second port.

20 Claims, 12 Drawing Sheets

(58) Field of Classification Search
CPC ..... H01Q 19/30; H01Q 21/08; H01Q 21/10; H01Q 21/12; H01Q 21/24; H01Q 25/00; H01Q 25/005; H01Q 9/36; H01Q 11/02; H01Q 11/10; H01Q 11/105; H01Q 5/25
See application file for complete search history.

(56) References Cited

U.S. PATENT DOCUMENTS

| | | | | |
|---|---|---|---|---|
| 5,093,670 | A | 3/1992 | Braathen | |
| 6,121,937 | A | 9/2000 | Podger | |
| 2008/0122729 | A1 | 5/2008 | Philippakis | |
| 2009/0102705 | A1 | 4/2009 | Obermeyer | |
| 2010/0182212 | A1 | 7/2010 | Lin | |
| 2011/0148729 | A1 | 6/2011 | Ro et al. | |
| 2014/0232605 | A1 | 8/2014 | Kim et al. | |
| 2017/0237174 | A1* | 8/2017 | Nysen ..... | H01Q 11/10 343/821 |

OTHER PUBLICATIONS

International Searching Authority, International Search Report and Written Opinion received for International Application No. PCT/SE2018/050038, 14 pages, Swedish Patent and Registration Office, Sweden.

Johnson, Richard C., Editor, "Antenna Engineering Handbook", Chapter 14, Frequency-Independent Antennas (See Symmetric Log-Periodic Structures) by Raymond H. DuHamel and James P. Scherer, Copyright 1993, pp. 14-41-14-42, Fig. 14-36, retrieved from https://vdocuments.site/download/antenna-engineering-handbook-586d957f62906 on Jul. 13, 2020.

Greiser, John W., "A New Class of Log-Periodic Antennas", Proceedings of the IEEE, May 1964, pp. 617-618, vol. 52, No. 5, IEEE, U.S.

Chen, Jinxi, et al., "Design of a Compact Log-Periodic Dipole Array Using T-Shaped Top Loadings", IEEE Antennas and Wireless Propagation Letters, Jan. 11, 2017, pp. 1585-1588, vol. 16, IEEE, U.S.

European Patent Office, Extended European Search Report received for Application No. 18901346.9, dated Jul. 19, 2021, 11 pages, Germany.

* cited by examiner

DUAL DIRECTIONAL LOG-PERIODIC ANTENNA AND AN ANTENNA ARRANGEMENT

CROSS REFERENCE TO RELATED APPLICATIONS

This application is a National Stage Application, filed under 35 U.S.C. § 371, of International Application No. PCT/SE2018/050038, filed Jan. 18, 2018; the contents of which are hereby incorporated by reference in their entirety.

BACKGROUND

Related Field

The present disclosure relates to an antenna. Further, the present disclosure relates to an antenna arrangement.

Description of Related Art

A log-periodic antenna is partly defined in the following: If an antenna is mapped onto itself given a scaling of the dimensions with a factor $1/\tau$, it obtains the same antenna characteristics at frequencies f and $\tau$*f. Antenna characteristics become periodic with respect to the logarithm of the frequency and the period will be $|\log(\tau)|$. Antennas designed using these principles are called "log-periodic" antennas. The scaling condition described is a condition necessary but not sufficient to obtain log-periodically varying antenna characteristics. In reality, no antennas are truly "log-periodic". A real antenna is of course truncated at the "large size end" and "small size end", which results in bandwidth limitations. The large size end determines the lower frequency limit and the small size end (usually located near the feed point) determines the higher frequency limit.

A traditional log-periodic antenna often consists of a series of dipole antenna elements positioned along a support boom lying along an axis. The support boom also acts as a (two conductor) feed line. Consecutive elements along the feed line increase in length seen from the feed point positioned at one end of the feed line. The elements are spaced at intervals following given scaling rules, likewise the length of the elements increase according to these rules of scaling. The dipole elements are resonant at different frequencies in order to cover the whole frequency range of the antenna. Often a traditional antenna also radiates in the "backfire direction", i.e. in the direction opposite to the wave traveling along the feed line, by virtue of "phase reversal" between consecutive elements along the feed line. Such a traditional antenna is often referred to as a log-periodic dipole array antenna.

There are also monopole versions of log-periodic array antennas. In order to obtain "backfire radiation" in such antennas special measures have to be taken in order to obtain "phase reversal". All monopole antennas require a ground plane. In a practical situation the ground plane does not have to be particularly large, nor even flat.

CA713169 discloses an antenna structure of the logarithmically periodic type. The structure consists of a longeron to which radiating elements are attached. The lengths of the radiating elements are proportional to their distance from the apex and are trapezoidal or triangular in shape, the radiating elements lying in the planes forming the angle between the arrays.

Log-periodic arrays are interesting for low frequency electronic warfare applications both for jamming and passive direction finding. However, log-periodic dipole or monopole arrays are bulky and by necessity protrude from the vehicle or construction they are installed on. Their complementary counterpart: log-periodic slot arrays can be made conformal to the surface of a vehicle but on the other hand they require bulky cavities beneath them in order to work; these cavities often also have to be at least partially filled with absorbers, which often is unacceptable in applications requiring high power transmission.

BRIEF SUMMARY

The invention relates to an antenna. The antenna comprises a feed line having first and second ends on opposite sides of the feed line, wherein a transmission axis is defined as the axis extending between the first and second ends of the feed line. Further, the antenna comprises a plurality of antenna elements arranged along the feed line, protruding from the transmission axis. The antenna also comprises a first port at the first end of the feed line. At a first part of the antenna, the feed line, from the first port towards a reference point along the transmission axis, comprises antenna elements of gradually increasing length, in a direction perpendicular to the transmission axis, and gradually increasing mutual distance between two consecutive antenna elements along the transmission axis, such that the antenna, by means of the antenna elements located at the first part of the antenna, is configured to radiate in a first direction along the transmission axis from the reference point towards the first port during excitation in the first port. Yet further, the antenna comprises a second port at the second end of the feed line. At a second part of the antenna, the feed line, from the second port towards the reference point along the transmission axis, comprises antenna elements of gradually increasing length, in a direction perpendicular to the transmission axis, and gradually increasing mutual distance between two consecutive antenna elements along the transmission axis, such that the antenna, by means of the antenna elements located at the second part of the antenna, is configured to radiate in a second direction along the transmission axis from the reference point towards the second port during excitation in the second port.

What is obtained is a dual directional antenna, radiating in two opposite directions when fed in two different ports. The dual directional antenna saves considerable space compared to two separate single directional antennas.

In one example, phase reversal is implemented between every two consecutive antenna elements. Phase reversal between every two consecutive antenna elements is a necessity to obtain a "backfire radiating" antenna, i.e. an antenna which has a main lobe pointing in the direction opposite to the direction of the wave traveling along the feed line. Phase reversal also increases the directivity, and thereby the gain, of the antenna considerably in comparison to a log-periodic antenna without phase reversal which radiates mainly along the transmission line.

According to another example, the antenna comprises a ground plane arranged in parallel with the transmission axis and wherein the antenna elements protruding from the transmission axis are protruding away from the ground plane in a direction perpendicular to the ground plane. An advantage of that the ground plane is attached to the antenna is that the antenna will work also without an external surface acting as a ground plane.

In yet another example, the antenna elements are protruding in a direction perpendicular to the transmission axis. An advantage is that the antenna is easy to produce if the antenna elements are protruding in a direction perpendicular to the transmission axis. Further, less space in the directions along the transmission axis is needed.

According to further example, each antenna element is formed as a folded antenna element as part of the feed line protruding from the transmission axis. An advantage is that phase reversal is inherent in the meander-line constituting the elements. Thus, the folded antenna elements are suitable for the design of an antenna with the main lobe in the "backfire" direction.

According to another example, each antenna element further comprises a parasitic element protruding from the ground plane into the folded antenna element. The parasitic element is configured to tune phase progression and element excitation along the feed line and to improve phase reversal between every two consecutive antenna elements. With the parasitic element the radiation resistance of the elements can be tuned. The parasitic element provides an additional feature which improves the performance of the antenna element in terms of optimisation, stabilisation and sensitivity to tolerances.

In another example, a reference antenna element is positioned at the reference point along the transmission axis, belonging to both the first part of the antenna and the second part of the antenna, wherein the reference antenna element is the longest antenna element, wherein the reference antenna element together with the antenna elements located at the first part of the antenna are configured to radiate in the first direction during excitation in the first port and wherein the reference antenna element together with the antenna elements located at the second part of the antenna are configured radiate in the second direction during excitation in the second port. An advantage is that less space is required in the directions along transmission line, since the reference antenna element is shared by the first and second parts of the antenna.

In further example, the antenna elements are T-shaped or disc shaped antenna elements. An advantage is that capacitive loading is achieved which results in that each antenna element has a shorter length than the corresponding antenna elements without capacitive loading, i.e. not being T-shaped or disc shaped.

In a yet further example, at the first part of the antenna, an imaginary first straight line can be formed between the centre of the top of each antenna element, such that the extension of the imaginary first straight line crosses the extension of the transmission axis at a first vertex, and wherein, at the second part of the antenna, an imaginary second straight line can be formed between the centre of the top of each antenna element, such that the extension of the imaginary second straight line crosses the extension of the transmission axis at a second vertex.

Further, at the first part of the antenna, the relation between the length of each antenna element and its distance to the first vertex is constant, and the distance between each consecutive antenna element and the first vertex, starting from the first vertex, increases with a first constant factor $\tau_1$ for each consecutive antenna element, and wherein at the second part of the antenna, the relation between the length of each antenna element and its distance to the second vertex is constant, and the distance between each consecutive antenna element and the second vertex, starting from the second vertex, increases with a second constant factor $\tau_2$ for each consecutive antenna element. An advantage is that a dual directional log-periodic antenna is obtained.

According to one example, each of the first part of the antenna and the second part of the antenna comprises at least three antenna elements, preferably at least five antenna elements, more preferably at least seven antenna elements. An advantage of more antenna elements is that the gain increases and reflection losses decrease.

According to another example, each of the antenna elements is a monopole. An advantage is that attachment of the antenna to a surface is facilitated.

According to a further example, each of the first part and the second part of the antenna is essentially log-periodic. Further, the antenna is easier to produce than if strictly log-periodic. Moreover it can be tuned over narrowband regions in the otherwise general broadband designed antenna.

In another example, each of the first part and the second part of the antenna is a Log-Periodic Folded Monopole Array Antenna, LPFMA.

In yet another example, the antenna is designed to operate between 0.15 GHz and 1.0 GHz. An advantage is that considerable space is saved by using a dual directional antenna in this frequency spectrum. The space saved along the transmission axis is approximately 15% to 20% compared to having two separate antennas. This is very valuable when the antennas mounted to a vehicle.

Further, the invention relates to an antenna arrangement. The antenna arrangement comprises an elongated member and first and second antennas. Each of the antennas is attached to a respective surface along the elongated member. Each respective surface is arranged to constitute at least part of the ground plane for the first and second antennas, respectively. The antenna elements are protruding away from the respective surface, such that the transmission axes of the first and second antennas are parallel to each other and such that the antenna elements of the first antenna are protruding in a direction inclined to the antenna elements of the second antenna. An advantage is that arbitrary polarisation states can be obtained in the main beam directions (along the transmission axis) when combining the two dual directional antennas.

In one example, the first port of the respective antenna are connected to each other via a first 180° hybrid, such that each respective first port can be operated either in phase or 180° out of phase, and the second port of the respective antenna are connected to each other via a second 180° hybrid, such that each respective second port can be operated either in phase or 180° out of phase. Thus four different types of patterns are obtained. An advantage is that these patterns can be combined and compared to each other for passive direction finding purposes. By amplitude comparisons, unwanted signals can be blocked and only measurements in the angular range giving uniqueness allowed. The prerequisite is that polarisation discrimination can be made, e.g. linear vertical, linear horizontal or circular. Another advantage is that the system also can be used for polarization matched jamming (linear vertical or horizontal) given that some polarization discrimination can be made.

BRIEF DESCRIPTION OF THE FIGURES

The disclosure will be further described with reference to the accompanying drawings.

DETAILED DESCRIPTION OF VARIOUS EMBODIMENTS

Figure 1:
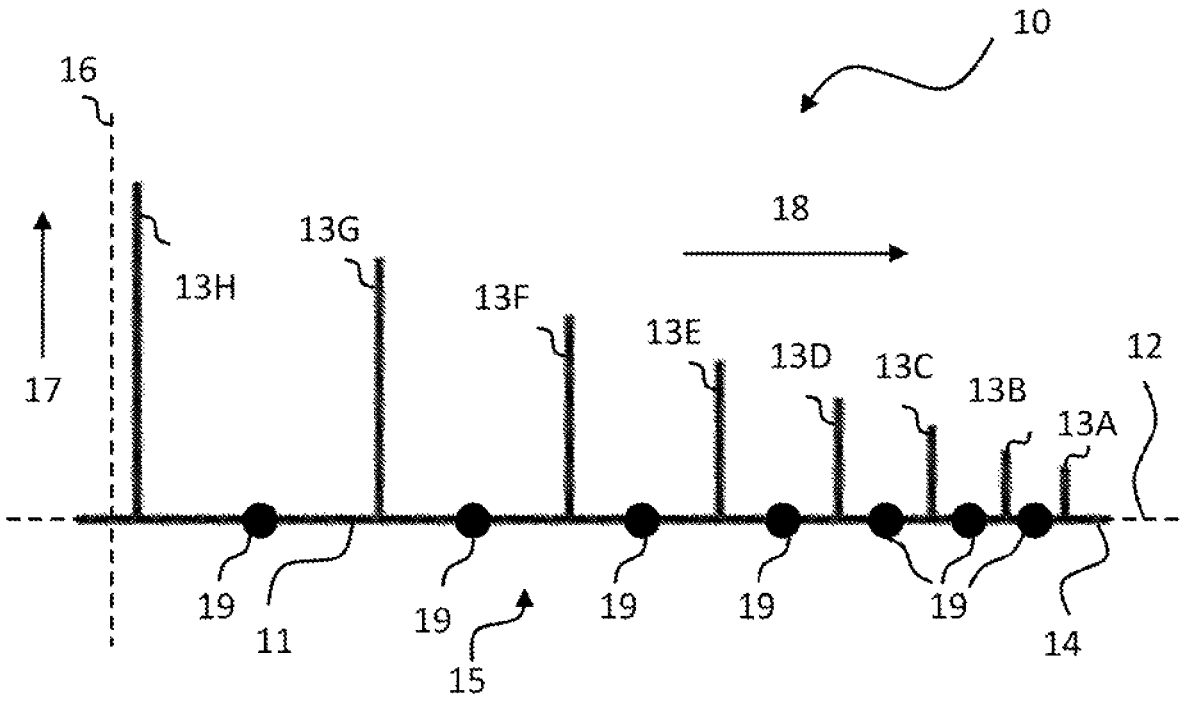
FIG. 1 (Prior Art)
FIG. 1 illustrates a schematic drawing of a log-periodic monopole antenna according to prior art.

In this disclosure the term "antenna" includes the terms "antenna array" and "array". FIG. 1 illustrates a schematic drawing of a log-periodic monopole antenna 10 according to prior art. The antenna 10 comprises a feed line 11 having first and second ends on opposite sides of the feed line 11. A transmission axis 12 is defined as the axis extending between the first and second ends of the feed line 11. Further, the antenna 10 comprises a plurality of antenna elements 13A, 13B, 13C, 13D, 13E, 13F, 13G, 13H arranged along the feed line 11, protruding from the transmission axis 12. The antenna 10 also comprises a port 14 at the first end of the feed line 11, wherein a part 15 of the antenna 10, from the port towards a reference point 16 along the transmission axis 12, comprises antenna elements 13A-H of gradually increasing length, in a direction 17 perpendicular to the transmission axis 12, and gradually increasing mutual distance between two consecutive antenna elements 13A-13B, 13B-13C, 13C-13D, 13D-13E, 13E-13F, 13F-13G, 13G-13H along the transmission axis 12. Further, between each antenna element phase reversal 19 is implemented in order to make the antenna radiate in a first direction 18, the "backfire" direction, increase the directivity, and thereby the gain, of the antenna 10. The dot 19 is an abstract symbolisation of phase reversal which can be implemented in different ways. Thereby the antenna 10, by means of the antenna elements 13A-H and the phase reversals 19, is configured to radiate in the first direction 18 along the transmission axis 12 from the reference point 16 towards the port 14 during excitation in the port 14.

Figure 2:
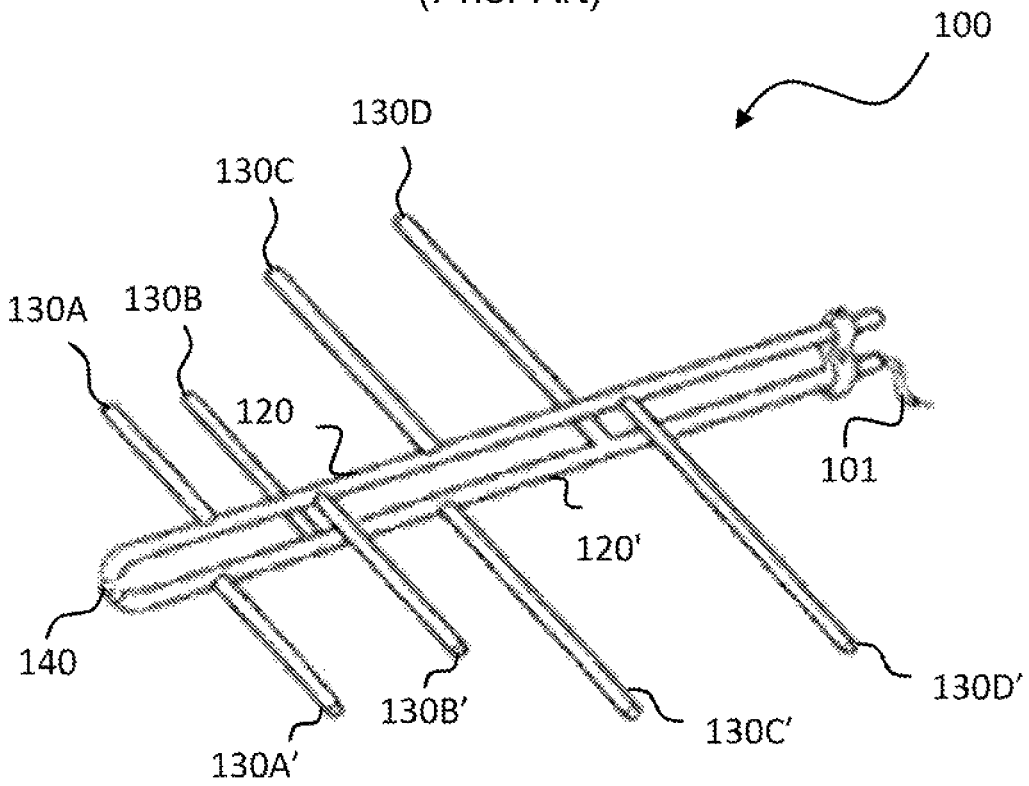
FIG. 2 (Prior Art)
FIG. 2 shows an example of a log-periodic dipole antenna according to prior art.

The first log-periodic antenna was reported in literature during the 1950's. The most common form of log-periodic antenna, the Log-Periodic Dipole Array (LPDA) is presented in FIG. 2. Referring to FIG. 2, the antenna 100 is fed from the left side via a coaxial line 101, the coaxial line feeds a two-conductor line 120, 120' via a port 140. The antenna 100 comprises four monopole antenna elements 130A, 130B, 130C, 130D protruding in a first direction, perpendicular to the two-conductor line 120, 120', every second antenna element 130A, 130C from the upper two-conductor line 120 and every second antenna element 130B, 130D from the lower two-conductor line 120'. Similarly, the antenna 100 comprises four monopole antenna elements 130A', 130B', 130C', 130D' protruding in a second direction, perpendicular to the two-conductor line 120, 120', opposite of the first direction, every second antenna element 130A', 130C' from the lower two-conductor line 120 and every second antenna element 130B', 130D' from the upper two-conductor line 120'. Elements 130A and 130A' together constitute a dipole, elements 130B and 130B' together constitute a dipole and so on. In this way, phase reversal is obtained by alternating the position of each dipole half along the two-conductor line. A wave progresses down the two-conductor line 120, 120' and encounters the successive dipole pairs 130A-130A', 130B-130B', 130C-130C', 130D-130D' down the line and radiates. The phasing of the successive elements 130 is such that it radiates to the left towards the port 140. The main beam maximum occurs in the so called backfire direction (to the left) because of the phase reversal between consecutive dipoles. If the phase reversals are not included, radiation will mainly occur close to the end-fire direction, to the right, meaning radiation from shorter elements successively illuminating longer elements to the right causing scattering and blockage producing scalloped patterns and erratic impedance behaviour. This is called end effect and has been observed many times.

An attempt to explain the basic operation of this type of log-periodic antenna is given in the following: Say that the dipole pairs are located at points $x=0$, $x=p_1$, $x=p_2$ and $x=p_3$ and so on. A wave which propagates along the two-conductor line (given TEM-conditions and harmonic time dependence $e^{i\omega t}$) will have a phase of 0, $e^{-ikp_1}$, $e^{-ikp_2}$ and $e^{-ikp_3}$. By observing the radiation integrals, one can see that constructive addition occurs in the end-fire direction, i.e., backfire direction $-\hat{x}$, if dipoles placed at these positions are excited with phase 0, $e^{ikp_1}$, $e^{ikp_2}$ and $e^{ikp_3}$. This is, within certain limits, the case regardless of positions but if the antenna is to appear as log-periodic, scaling condition must of course be fulfilled. By reversing the phase at consecutive positions of the dipole-pairs, the condition above is satisfied. The phase reversal is obtained by alternating the position of each dipole half along the two-conductor line as can be seen in FIG. 2. Usually log-periodic antennas are not log-periodic in every aspect. As can be seen in FIG. 2, the feed line is not scaled from antenna element to antenna element, nor is the dipole width, but the most essential dimensions are the dipole lengths and the consecutive distances between elements and a vertex in front of the antenna, which are both scaled by the same factor.

Figure 3:
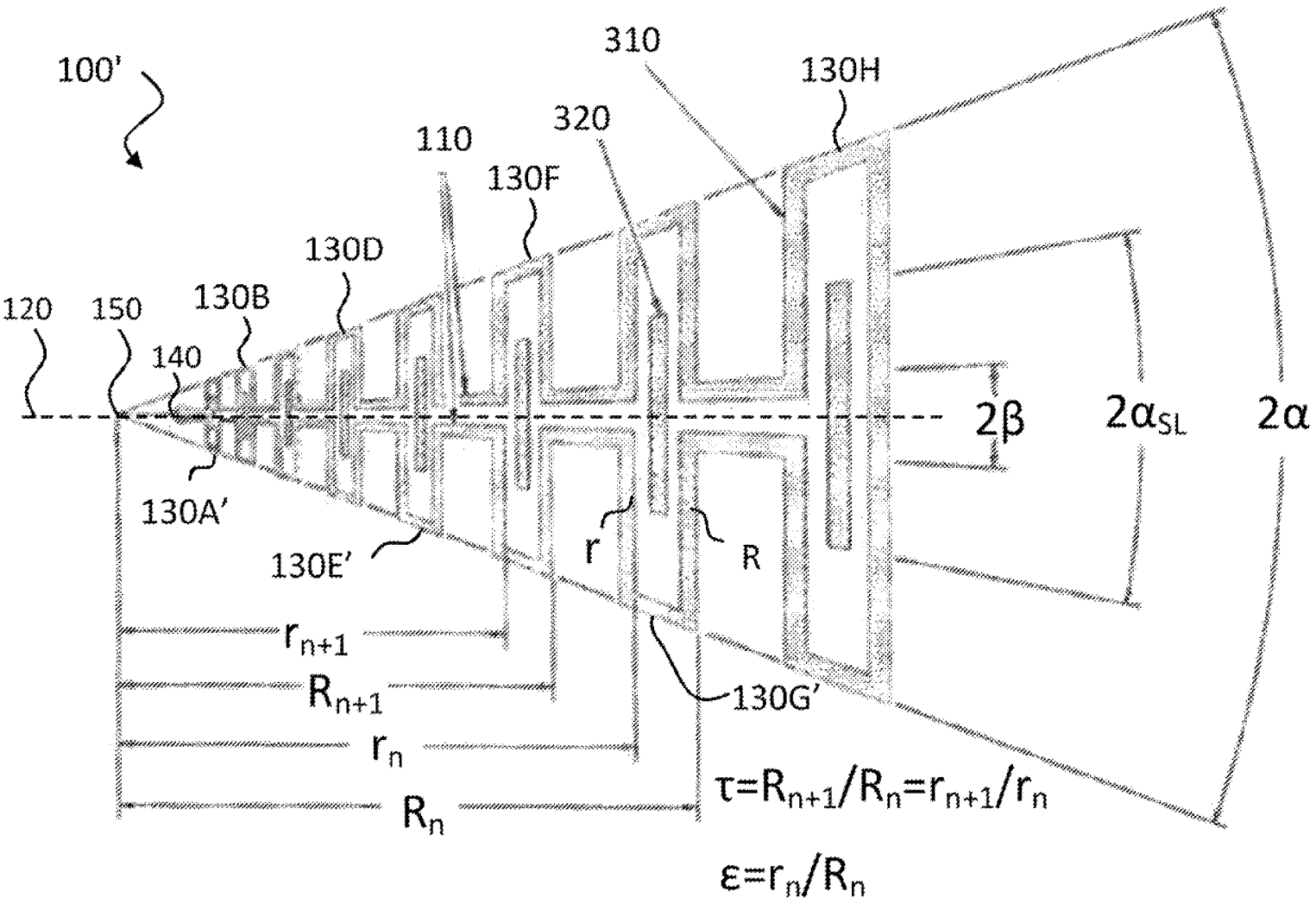
FIG. 3 (Prior Art)
FIG. 3 illustrates a log-periodic folded slot or dipole array with parasitic elements according to prior art.

In FIG. 3, yet another type of log-periodic antenna is shown, a log-periodic folded slot array 100' with parasitic slot elements 320. The antenna 100' comprises eight antenna elements 130A-130H, protruding in a direction, perpendicular to the transmission axis 120, and eight antenna elements 130A'-130H', protruding in a direction, perpendicular to the transmission axis 120, in the opposite direction of the eight antenna elements 130A-130H. Further, a feed line 110 of which the main extension is arranged almost parallel, but diverging with a small angle β in relation to the transmission axis 120, is connected to a port 140.

The feedline 110 also constitutes each of the antenna elements 130A-H. For each antenna element 130A-H, the feedline 110 protrudes perpendicular to the transmission axis 120 until the feedline 110, 310 reaches the extension of a line by an angle α to the transmission axis 120 from a vertex 150. Thereafter, the feedline 110, 310 follows the extension of the line by an angle α to the transmission axis 120 for a distance $R_{n+1}-r_{n+1}$. Then, the feedline 310 turns back, perpendicular to the transmission axis 120 until the feedline 310 reaches the extension of the feedline 110, directed by an angle β to the transmission axis 120 from the vertex 150.

Each consecutive antenna element 130A-H, starting from the port 140, increases with the factor τ. The factor τ is calculated by measuring the distance from each of two consecutive antenna elements 130A-H to the vertex 150. In one example, the distance from each of two consecutive antenna elements 130A-H to the vertex 150 is measured at a first leg, r, of each antenna element, seen from the port 140. In another example, the distance from each of two consecutive antenna elements 130A-H to the vertex 150 is measured at a second leg, R, of each antenna element 130A-H, seen from the port 140. The relation between the factor t and the distance from each of two consecutive antenna elements 130A-H to the vertex 150 is explained by:

$$\tau=R_{n+1}/R_n=r_{n+1}/r_n;$$

where n is the current antenna element 130A-H, seen from the port 140.

Further, the width of each antenna element 130A-H is dependent of the distance from the current antenna element 130A-H to the vertex 150. This relation is given by the factor ε: $\varepsilon=r_n/R_n$.

The feedline 110, 310 forms antenna elements 130A-H, 130A'-H' on both sides of the transmission axis 120 such that a slot dipole antenna is formed.

Within each antenna element 130A-H a parasitic slot element 320 is provided. The parasitic slot element 320 extends, on both sides of the transmission axis 120, from the transmission axis 120 to the extension of the line by an angle $\alpha_{SL}$ to the transmission axis 120 from the vertex 150. The relation between the angle α, $\alpha_{SL}$, β is given by: $\alpha>\alpha_{SL}>\beta$, $\alpha>>\beta$. The parasitic slot element 320 provides an extra design parameter by which the phase progression along the line and phase excitation of the elements along the line can be tuned when elements are resonant; the phase reversal is inherent in the antenna element due to the meander type of feed line exhibited. This antenna is symmetrical with respect to the transmission axis 120 and a plane orthogonal to the elements, which gives interesting properties. It can also easily be implemented as its self-complementary counterpart, a folded version with parasitic elements. Since its self-complementary folded dipole version also is symmetrical with respect to the transmission axis 120 and a plane which is orthogonal to the elements and in which the transmission axis lies, the self-complementary log-periodic folded dipole array can easily be turned into a log-periodic folded monopole array version by "cutting it into half" at the transmission axis 120 and by adding a conducting ground plane at the plane of symmetry giving a virtual symmetry.

Figure 4:
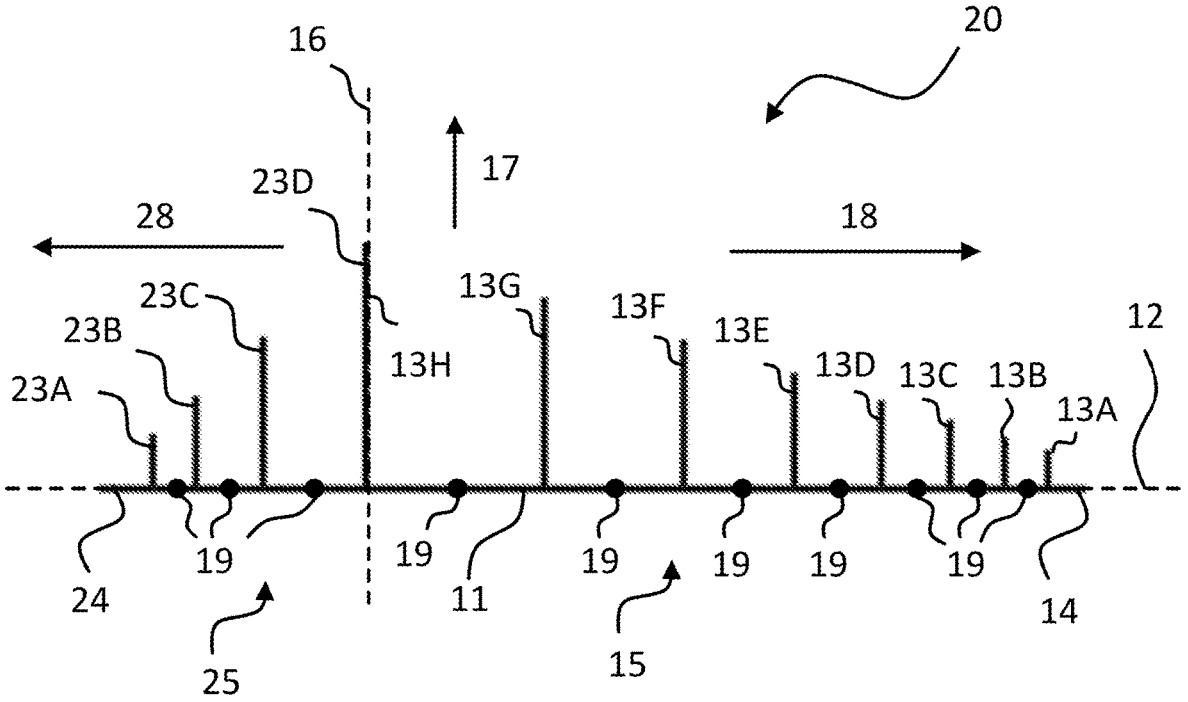
FIG. 4 shows a schematic drawing of a dual directed log-periodic monopole antenna.

FIG. 4 shows a schematic drawing of a dual directed log-periodic monopole antenna. The dual directed antenna of FIG. 4 describes a development of the single directed antenna of FIG. 1. The antenna 20 comprises a feed line 11 having first and second ends on opposite sides of the feed line 11, having first and second ends on opposite sides of the feed line 11. A transmission axis 12 is defined as the axis extending between the first and second ends of the feed line 11. Further, the antenna 20 comprises a plurality of antenna elements 13A, 13B, 13C, 13D, 13E, 13F, 13G, 13H arranged along the feed line 11, protruding from the transmission axis 12. The antenna 20 also comprises a first port 14 at the first end of the feed line 11. A first part 15 of the antenna 20, seen from the first port 14 towards a reference point 16 along the transmission axis 12, comprises antenna elements 13A-H of gradually increasing length, in a direction 17 perpendicular to the transmission axis 12, and gradually increasing mutual distance between two consecutive antenna elements 13A-13B, 13B-13C, 13C-13D, 13D-13E, 13E-13F, 13F-13G, 13G-13H along the transmission axis 12. Further, between each antenna element phase reversal 19 is implemented in order to make the antenna radiate in the "backfire direction" 18, increase the directivity, and thereby the gain, of the antenna 20. The dot 19 in FIG. 4 is an abstract symbolisation of phase reversal which can be implemented in different ways. Thereby the antenna 20, by means of the antenna elements 13A-H located at the first part 15 of the antenna 20, and the phase reversals 19, is configured to radiate in a first direction 18 along the transmission axis 12 from the reference point 16 towards the first port 14 during excitation in the first port 14. The first part 15 of the antenna 20 may also be expressed as the first part 15 of antenna 20.

Yet further, the antenna 20 comprises a second port 24 at the second end of the feed line 11. A second part 25 of the antenna 20, seen from the second port 24 towards a reference point 16 along the transmission axis 12, comprises antenna elements 23A, 23B, 23C, 23D of gradually increasing length, in a direction 17 perpendicular to the transmission axis 12, and gradually increasing mutual distance between two consecutive antenna elements 23A-23B, 23B-23C, 23C-23D along the transmission axis 12. Further, between each antenna element, phase reversal 19 is implemented in order to make the antenna radiate in a second direction 28, the "backfire direction", increase the directivity, and thereby the gain, of the antenna 20. Thereby the antenna 20, by means of the antenna elements 23A-D located at the second part 25 of the antenna 20, and the phase reversals 19, is configured to radiate in the second direction 28 along the transmission axis 12 from the reference point 16 towards the second port 24 during excitation in the second port 24. Hence, a dual directional antenna is obtained, radiating in two opposite directions. The second part 25 of the antenna 20 may also be expressed as the second part 25 of antenna 20. The dual directional antenna saves considerable space compared to two separate single directional antennas.

The antenna elements 13A-H, 23A-D do not necessarily have to protrude in a direction 17 perpendicular to the transmission axis 12. The antenna elements 13A-H, 23A-D may protrude by any angle or form with respect to the transmission axis 12 as long as the antenna is configured to radiate in the directions 18, 28 along the transmission axis 12. However, the length of each antenna element is defined as the length of the antenna element in direction 17 perpendicular to the transmission axis 12. Still, in one example, as shown in FIG. 4, the antenna elements 13A-H, 23A-D are protruding in a direction 17 perpendicular to the transmission axis.

Usually a log periodic dipole, monopole or slot array has one feed point and is designed to radiate in one direction (preferably the "backfire direction"). This disclosure describes an essentially log periodic monopole (or dipole) array antenna designed to radiate in two opposite directions by virtue of two different ports on opposite sides of a common transmission line with elements gradually increasing in length from each port towards a point in between the ports along the transmission line. Thus, implementing phase reversals between elements, "backfire radiation" can be obtained when the antenna is fed in either port. This arrangement means that considerable space can be saved compared to having two one port antennas looking in opposite directions.

Figure 5:
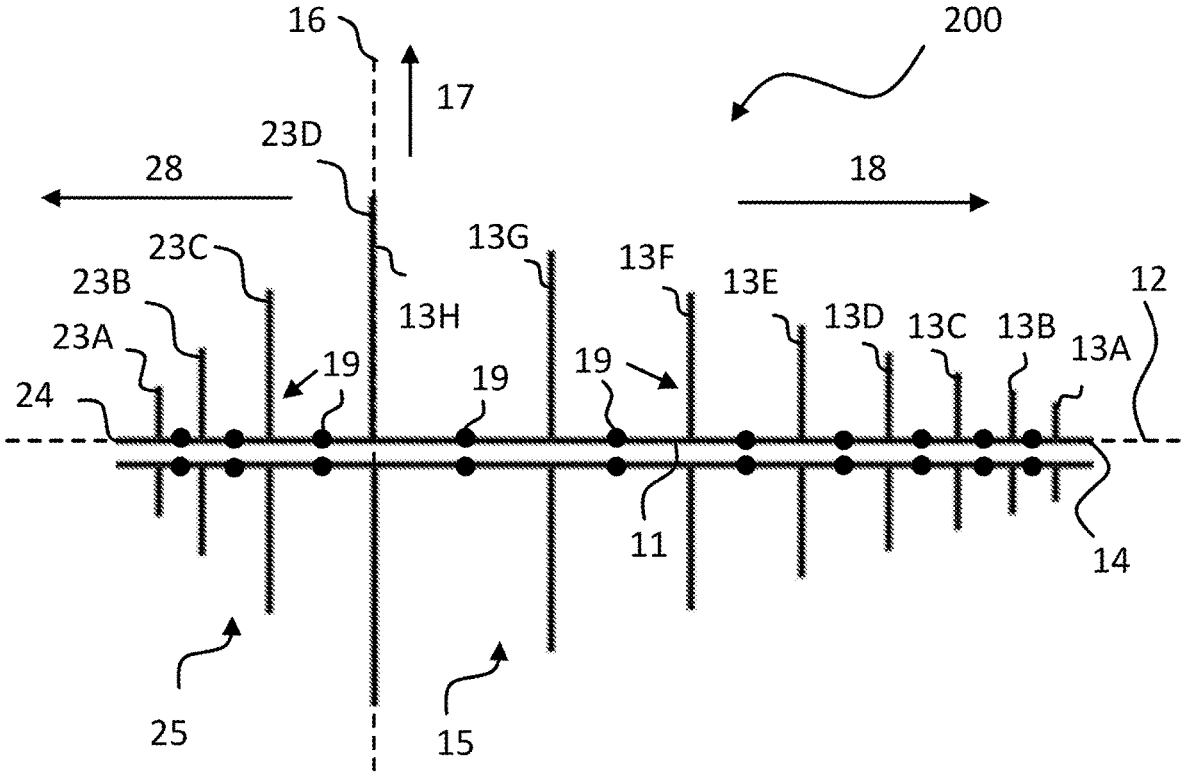
FIG. 5 shows a schematic drawing of a dual directed log-periodic dipole antenna.

FIG. 5 shows a schematic drawing of a dual directed log-periodic dipole antenna 200. The upper part of the dipole antenna 200 incorporates all features and references signs of the monopole antenna 20 of FIG. 4. Additionally, FIG. 5 comprises a mirrored lower part of the upper monopole antenna array thus forming a log-periodic dipole antenna 200, which also incorporates all features of the monopole antenna 20 of FIG. 4. Hence, a dual directed log-periodic dipole antenna 200 can be schematically drawn from two mirrored dual directed log-periodic monopole antennas 20.

Figure 6:
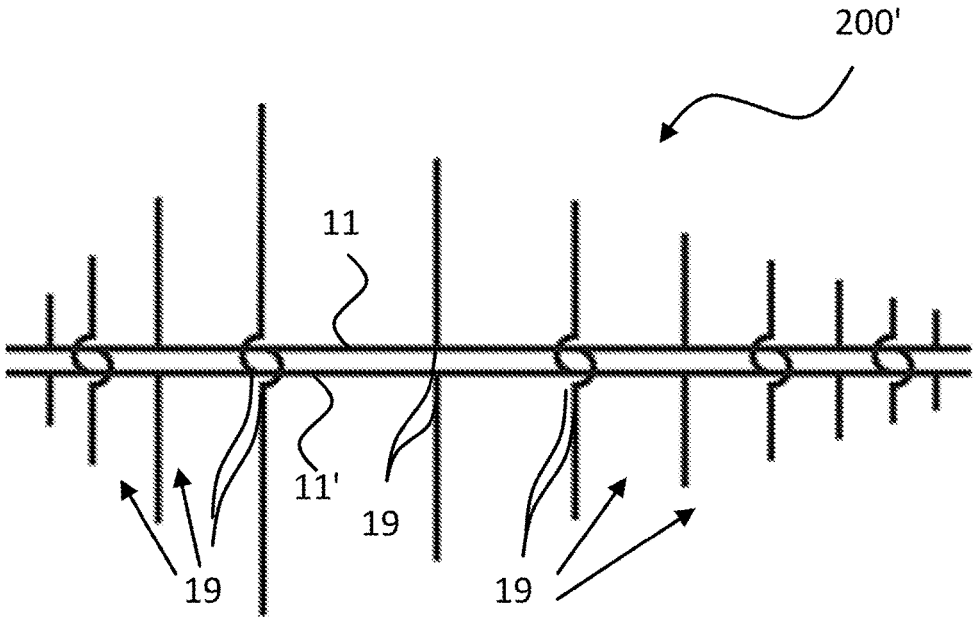
FIG. 6 illustrates a schematic drawing of an example of a dual directed log-periodic dipole antenna with an example of phase reversal between the antenna elements.

FIG. 6 illustrates a schematic drawing of an example of a dual directed log-periodic dipole antenna 200' with a particular implementation of phase reversal 19 between each antenna element. FIG. 6 incorporates all features and references signs of the monopole antenna 20 of FIG. 4 and the dipole antenna of FIG. 5. Phase reversals 19 are introduced by coupling every second monopole antenna element, pointing in the same direction 17, along the transmission axis 12 to the upper feed line 11 and every second monopole antenna element to the lower feed line 11'. However, this solution has the drawback that the antenna cannot be cut into two symmetrical halves along the transmission axis 12, since every second antenna is coupled to the upper feed line 11 and every second antenna element to the lower feed line 11'. This is the principle used to obtain phase reversal in the antenna pictured in FIG. 2.

Figure 7:
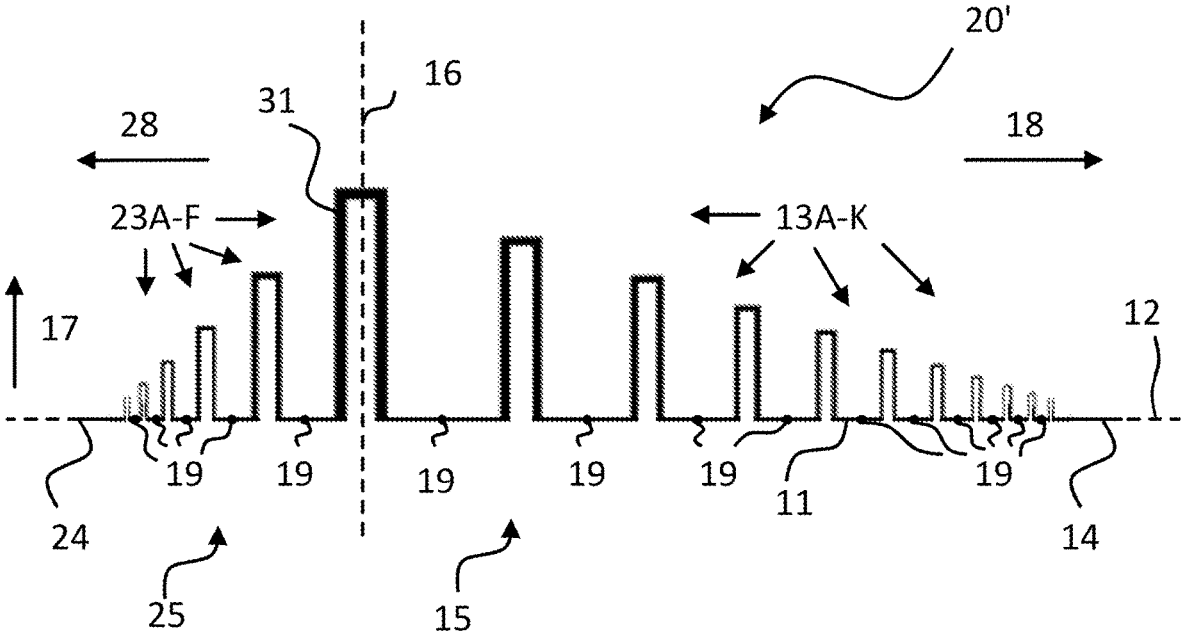
FIG. 7 shows an example of a dual directed folded monopole antenna.
Figure 8:
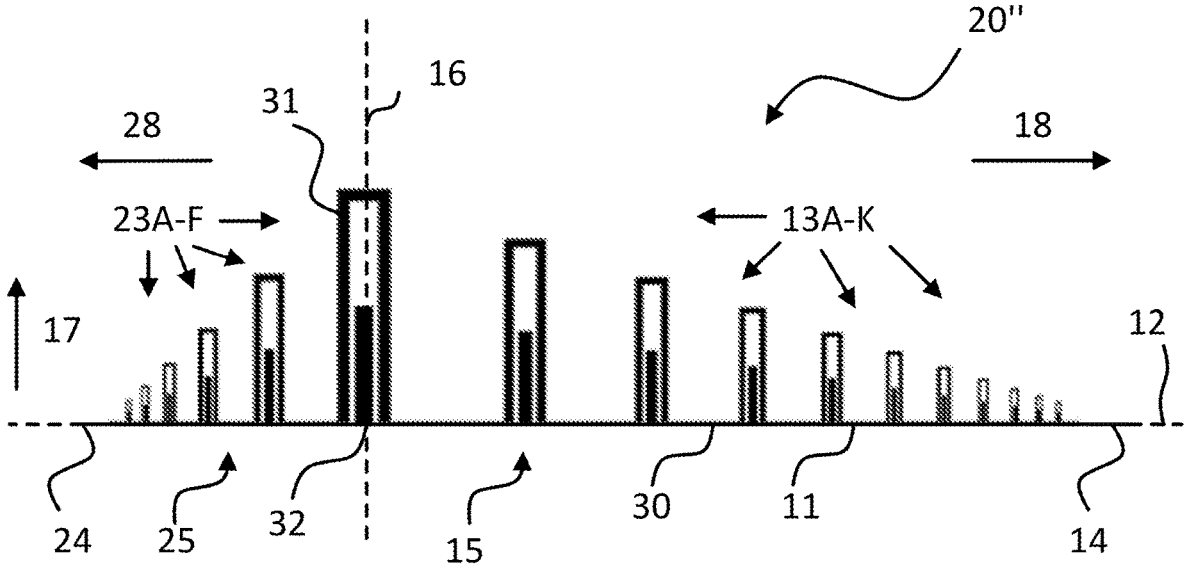
FIG. 8 illustrates an example of a dual directed folded monopole antenna with parasitic elements.

FIG. 7 shows an example of a dual directed folded monopole antenna 20'. Each antenna element 13A-K, 23A-F is formed as a folded antenna element 31 as part of the feed line 11 protruding from the transmission axis 12. Thus, the feed line 11 constitutes the folded antenna element 31. Seen from any of the two ports 14, 24, every consecutive antenna element along the transmission axis 12 increases in length, in the direction 17, and in width, along the transmission axis 12. The relations between the antenna elements have been described in detail in relation to FIG. 3 and will be further described in relation to FIG. 12. FIG. 8 illustrates an example of a dual directed folded monopole antenna 20" with parasitic elements. The antenna 20" comprises a ground plane 30 arranged in parallel with the transmission axis 12. All essentially log-periodic monopole antennas need a ground plane 30 in order to function. The ground plane 30 may be constituted by the metallic surface or body to which the antenna 20" is attached, such as a vehicle, an aircraft, a construction or a building, and/or may be rigidly attached to the antenna 20".

In one example, the antenna elements 13A-K, 23A-F protruding from the transmission axis 12, are protruding away from the ground plane 30 in the direction 17 perpendicular to the ground plane 30.

Further, in this example, each antenna element comprises a parasitic element 32 protruding from the ground plane 30 into the folded antenna element 31. The parasitic element 32 must not touch the folded antenna element 31. With the parasitic element 32, the radiation resistance of the elements can be tuned. The parasitic elements 32 provide an additional feature which improves the performance of the folded antenna elements 31 in terms of optimisation, stabilisation and sensitivity to tolerances. The parasitic elements 32 make the design more robust. The parasitic element 32 is configured to tune phase progression and element excitation along the feed line.

An array of log-periodic monopole arrays mounted on an aircraft constitutes a challenge from aerodynamic point of view. Thus there is a desire to reduce the size of the monopoles as much as possible in order to reduce the protrusions.

Figure 9:
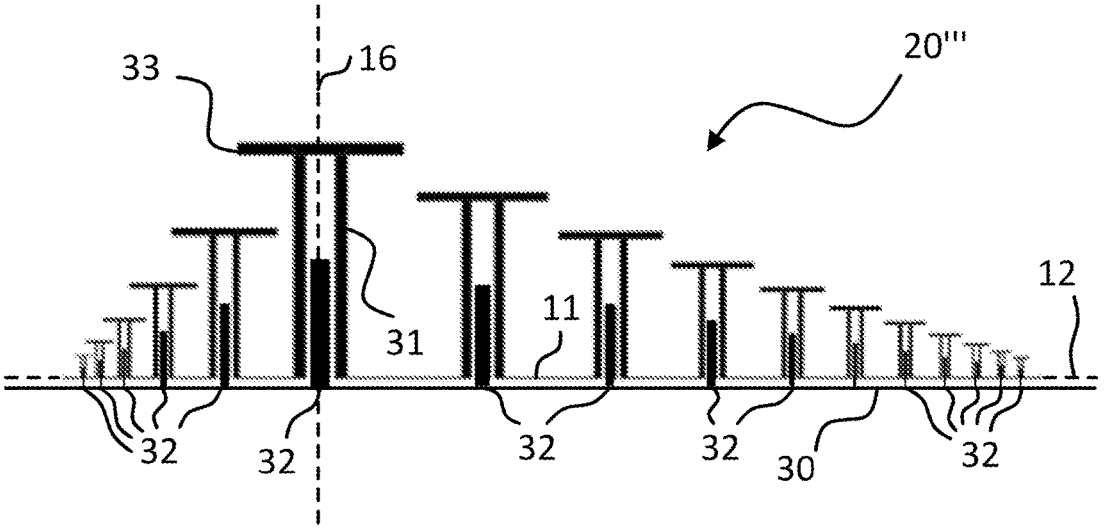
FIG. 9 shows an example of a dual directed monopole antenna with parasitic elements and T-shaped antenna elements.

FIG. 9 shows an example of a dual directed monopole antenna 20''' with parasitic elements 32 and T-shaped antenna elements 33. The antenna elements 13, 23 are T-shaped or disc shaped antenna elements 33. The T-shaped or disc shaped antenna elements 33 introduces capacitive top-loading which result in that each antenna element is shorter in the direction 17, perpendicular to the transmission axis 12, but also that each antenna element 33 is wider in the direction parallel to the transmission axis 12. Thus, the size of the capacitive top-loading can be chosen to optimise the available space in the direction 17, perpendicular to the transmission axis 12, and in the direction parallel to the transmission axis 12.

Further, the space between the transmission axis 12 and the ground plane 30 has been enlarged in FIG. 9 in order to show that the parasitic elements 32 and only the parasitic elements 32 are in contact with the ground plane 30.

Figure 10:
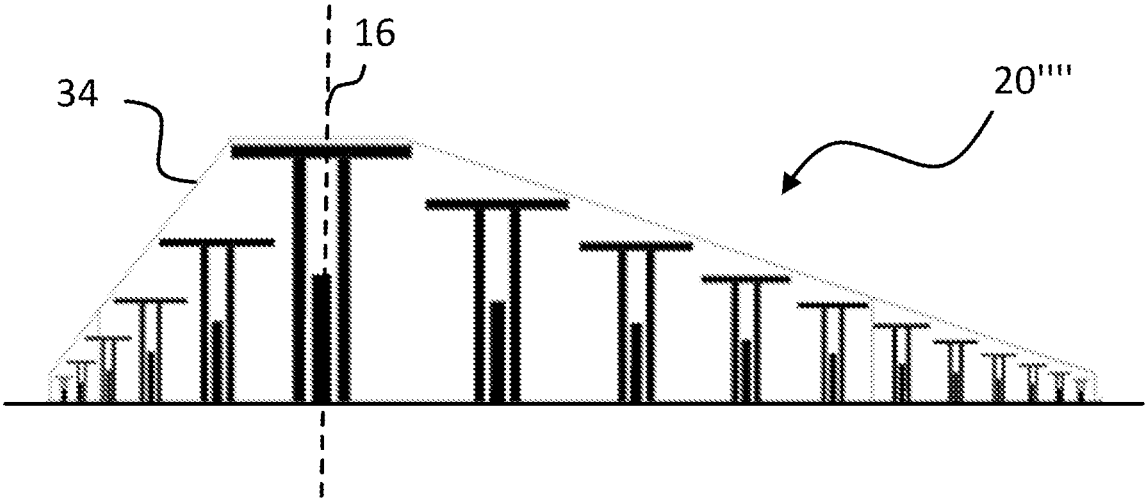
FIG. 10 illustrates an example of a dual directed folded monopole antenna embedded in dielectric.

FIG. 10 illustrates another example of a dual directed folded monopole antenna 20'''' embedded in dielectric material 14. FIG. 10 incorporates all reference signs from FIGS. 7-9. The dielectric material 14 makes the antenna 20'''' more robust. Hence, the feed line 11 and the folded antenna elements 31 can be made thinner than without the dielectric material 14. Preferably, there is no dielectric between the feed line and the ground plane.

Figure 11:
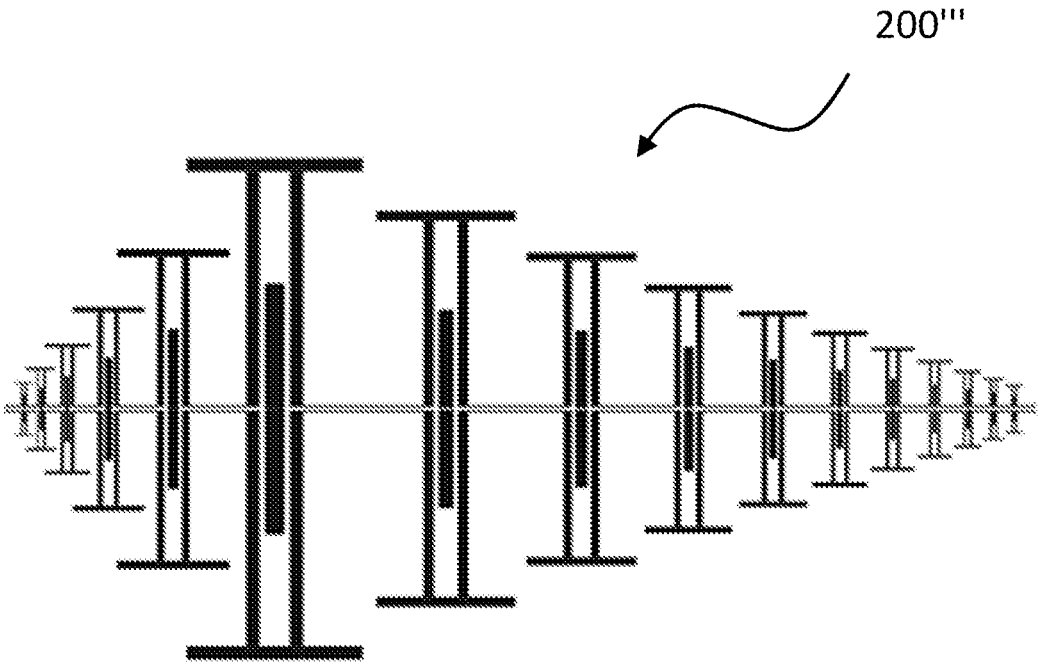
FIG. 11 illustrates an example of a dual directed dipole antenna.

FIG. 11 illustrates an example of a dual directed dipole antenna 200'''. FIG. 10 incorporates all reference signs from FIGS. 7-9 and shows that by mirroring any of FIGS. 7-9 over the transmission axis 12, a dual directed dipole antenna 200''' can be constructed.

Figure 12:
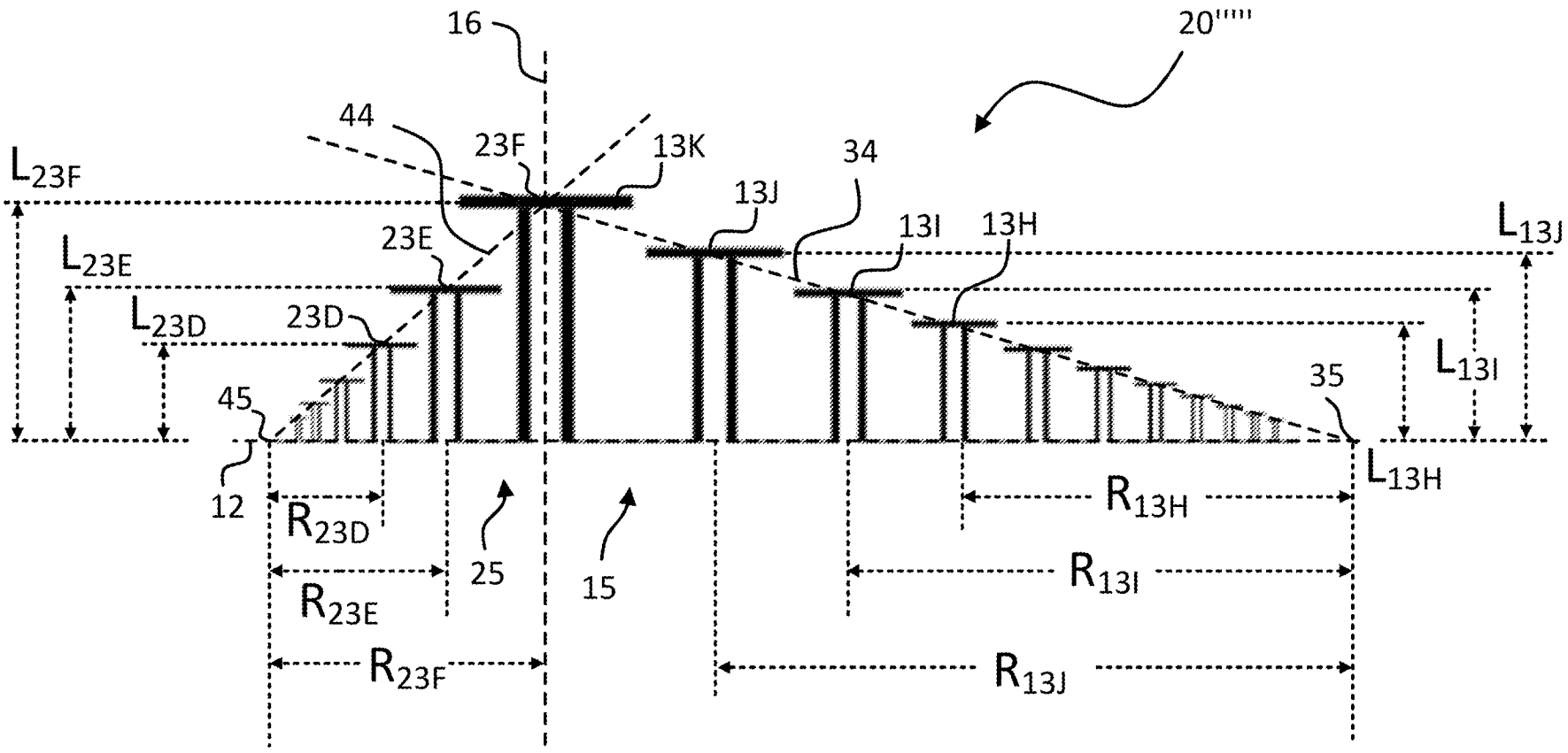
FIG. 12 shows the geometry of a dual directed log-periodic monopole antenna.

FIG. 12 shows the geometry of a dual directed log-periodic monopole antenna 20'''''. At the first part 15 of the antenna 20''''', an imaginary first straight line 34 can be formed between the centre of the top of each antenna element 13A-13K such that the extension of the imaginary first straight line 34 crosses the extension of the transmission axis 12 at a first vertex 35, and wherein, at the second part 25 of the antenna 20''''', an imaginary second straight line 44 can be formed between the centre of the top of each antenna element 23A-23F such that the extension of the imaginary second straight line 44 crosses the extension of the transmission axis 12 at a second vertex 45.

At the first part 15 of the antenna 20''''', the relation between the length L13A-L13K of each antenna element 13A-13H and its distance R13A-R13K to the first vertex 45 is constant, and the distance R13A-R13K between each consecutive antenna element 13A-13K and the first vertex 45, starting from the first vertex 45, increases with a first constant factor $\tau_1$ . . . , R13I/R13H, R13J/R13I, . . . for each consecutive antenna element 13A-13K.

Hence, the first constant factor $\tau_1$ can be described by:

$$\tau_1=R_{13B}/R_{13A}=R_{13I}/R_{13H}=R_{13J}/R_{13I}=R_{13K}/R_{13J}$$

The relation by of the length L13A-L13K of each antenna element 13A-13H and its distance R13A-R13K to the first vertex 35 is constant by a factor $I_1$. Hence, the relation between the length L13A-L13K of each antenna element 13A-13H can be described by $$I_1*\tau_1=L_{13B}/L_{13A}=L_{13I}/L_{13H}=L_{13J}/L_{13I}=L_{13K}/L_{13J}$$

Similarly, at the second part 25 of the antenna 20'''', the relation between the length L23A-L23F of each antenna element 23A-23F and its distance R23A-R23F to the second vertex is constant, and the distance between each consecutive antenna element and the second vertex, starting from the second vertex, increases with a second constant factor $\tau_2$ . . . , R23E/R23D, R23F/R23E, . . . for each consecutive antenna element.

Hence, the second constant factor $\tau_2$ can be described by:

$$\tau_2=R_{23B}/R_{23A}=R_{23E}/R_{23D}=R_{23F}/R_{23E}$$

The relation by of the length L23A-L13F of each antenna element 23A-23F and its distance R23A-R23F to the second vertex 45 is constant by a factor $I_2$. Hence, the relation between the length L23A-L13F of each antenna element 23A-23F can be described by $$I_2*\tau_2=L_{23B}/L_{23A}=L_{23E}/L_{23D}=L_{23F}/L_{23E}$$

The relation between factor $I_1$ and $I_2$ can be visually seen in FIG. 12 by the slope of the imaginary first straight line 34 and the imaginary second straight line 44.

According to an example, the reference antenna element 13K, 23F is positioned at the reference point 16 along the transmission axis 12, belonging to both the first part 15 of the antenna and the second part 25 of the antenna 20'''', wherein the reference antenna element 13K, 23F is the longest antenna element, wherein the reference antenna element 13K, 23F together with the antenna elements 13A-13K, located at the first part 15 of the antenna 20, are configured to radiate in the first direction 18 during excitation in the first port 14 and wherein the reference antenna element 13K, 23F together with the antenna elements 23A-23F, located at the second part 25 of the antenna 20, are configured radiate in the second direction 28 during excitation in the second port 24. Thus, an advantage of the configuration of having a reference antenna element 13K, 23F belonging to both the first part 15 of the antenna and the second part 25 of the antenna 20'''' is that the antenna 20'''', which is one antenna with two ports, will be considerably smaller than two separate one port antennas both having a largest element equal in size to element 23F, 13K and one antenna having a length R13K from its vertex to the middle of the largest element and the other antenna having a length R23F from its vertex to the largest element.

The antenna is particularly designed to operate between 0.15 GHz and 1.0 GHz. The antenna 20, wherein the first part 15 is an eleven antenna element Folded Monopole Array Antenna, LPFMA, having a size of 1420 mm×430 mm and wherein the second part 25 is a six antenna element, Folded Monopole Array Antenna, LPFMA, having a size of 600 mm×430 mm, wherein the longest element is shared by the first part 15 and the second part 25, the dual directional antenna 20 will be about 1790 mm×430 mm.

Hence, the dual directional essentially log-periodic antenna saves considerable space in comparison to two single directional essentially log-periodic antennas.

Figure 13:
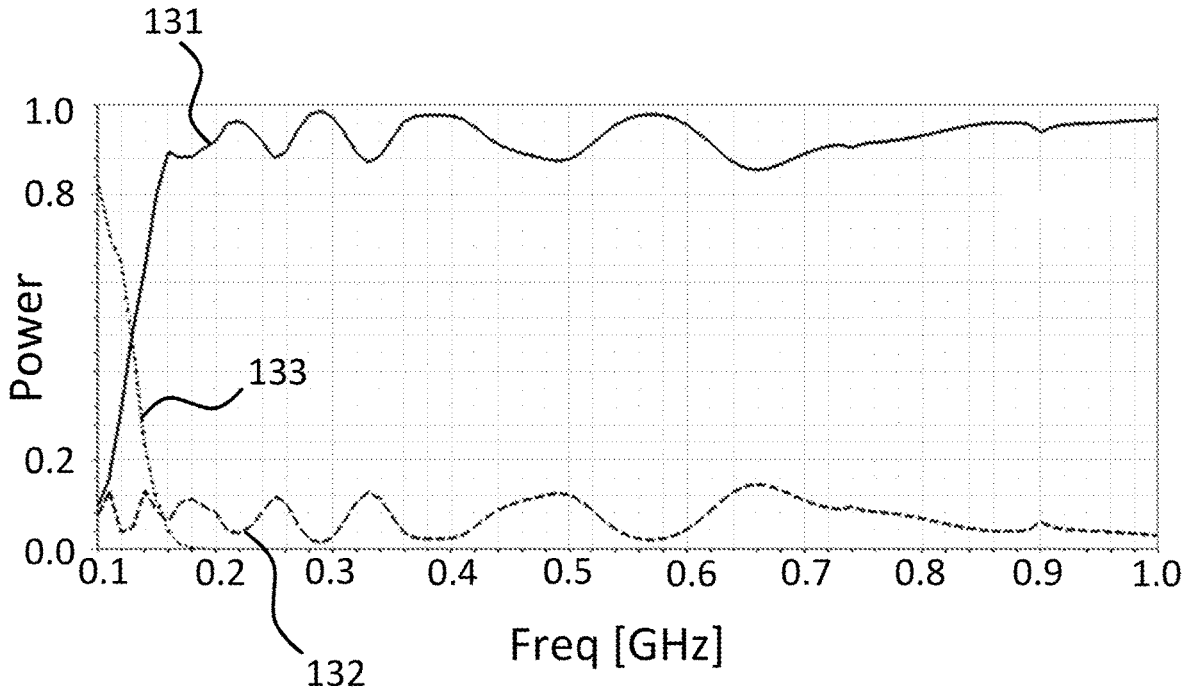
FIG. 13 illustrates performance of a single directed folded monopole antenna.
Figure 14:
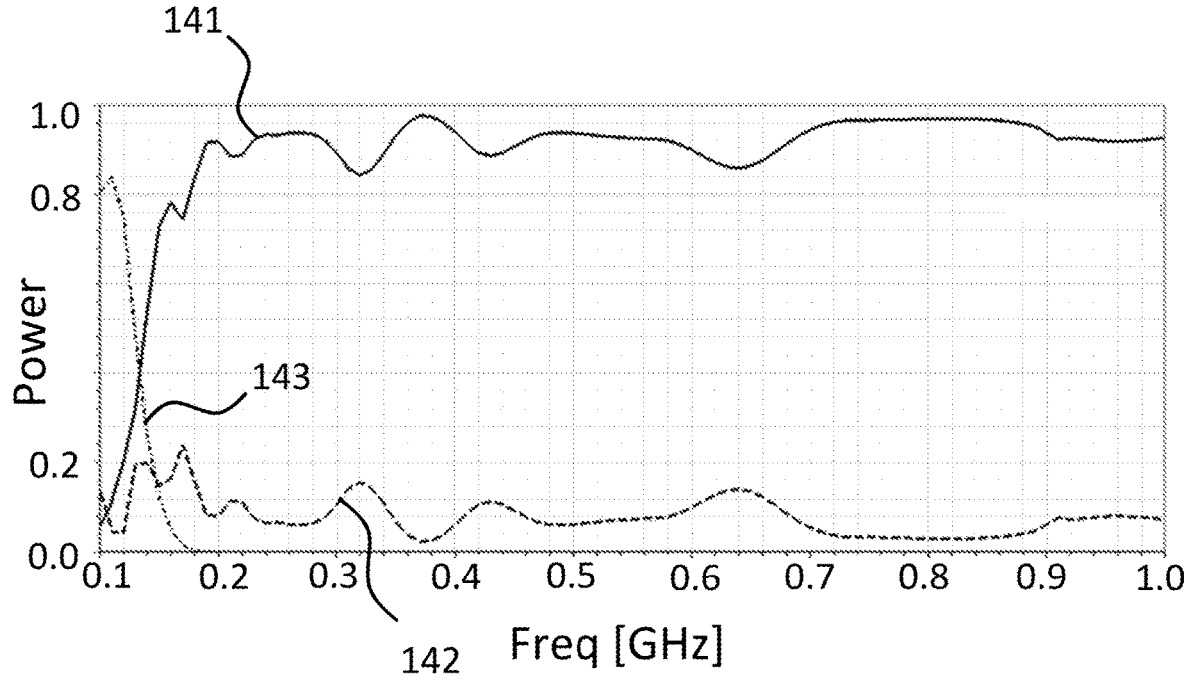
FIG. 14 shows performance of the dual directed folded monopole antenna of FIG. 9.

FIG. 13 illustrates performance of a single directed folded monopole antenna 10 comprising 11 antenna elements 13A-K, as the first part 15 of the antenna 20. The solid line 131 represents power radiated; the evenly dashed line 132 represents reflection loss; and the unevenly dashed line 133 represents transmission loss. FIG. 14 shows performance of the dual directed folded monopole antenna 20 of FIG. 9 comprising 16 antenna elements 13A-K, 23 A-F, as the first and second parts 15, 25 of the antenna 20, wherein the antenna element 13K/23F is in common for the first and second parts 15, 25. The solid line 141 represents power radiated; the evenly dashed line 142 represents reflection loss; and the unevenly dashed line 143 represents transmission loss. The lines 131/141, 132/142, 133/143 of FIGS. 13 and 14 virtually look the same. It has also been found that radiation patterns virtually look the same in both cases (but it is not shown here). The antenna elements 23 A-F at the second part 25 only affects the antenna elements 13A-K at the first part 15 to some extent at lower frequencies, below 200-300 MHz. It is also found that the antenna elements 13A-K at the first part 15 affects the antenna elements 23 A-F at the second part 25 somewhat more but not to a significant extent; the second part 25 can still be used as auxiliary antenna for reception but not for broad band high power transmission.

Figure 15:
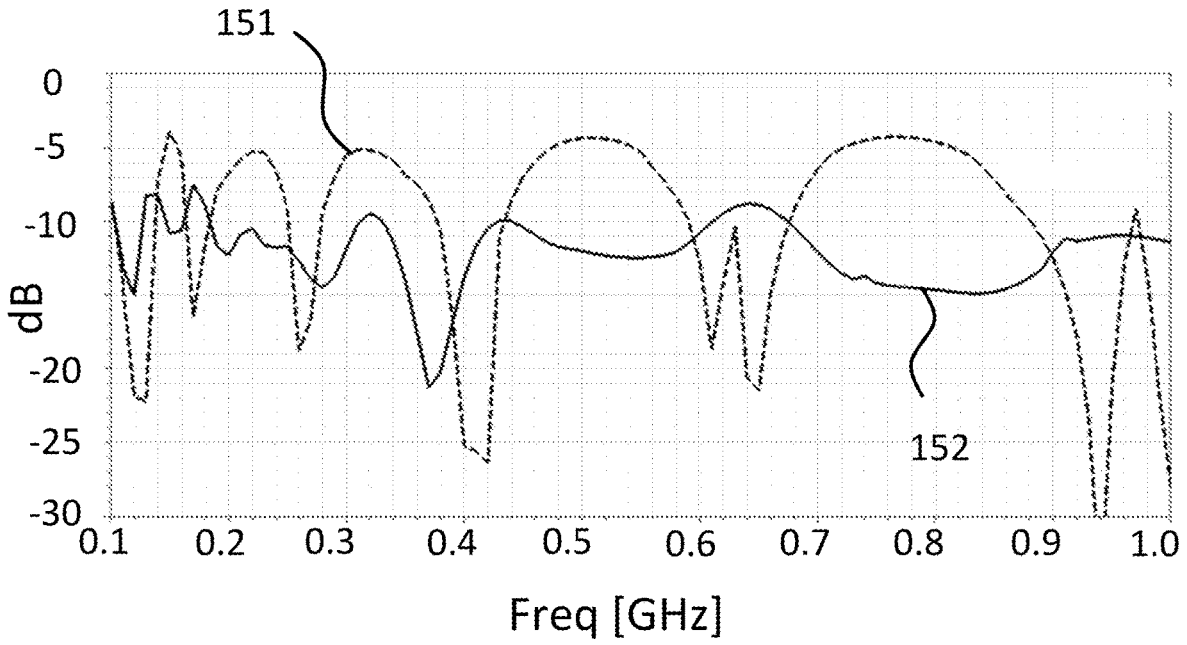
FIG. 15 illustrates reflection in a first port and in a second port of the antenna of FIG. 9.
Figure 16:
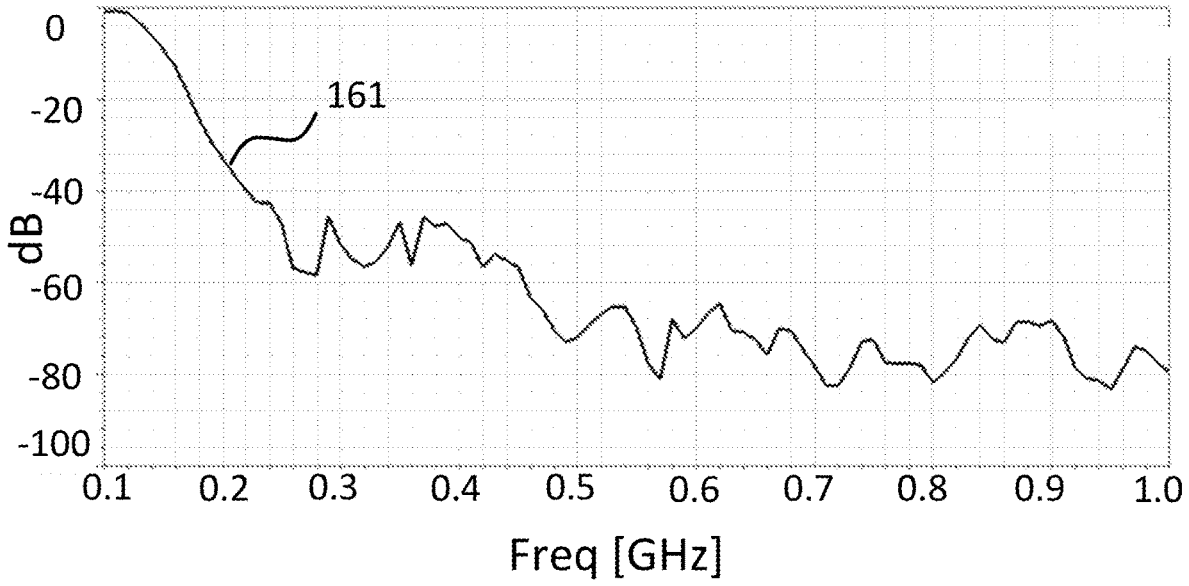
FIG. 16 shows transmission between a first port and a second port of the antenna of FIG. 9.

FIG. 15 illustrates reflection in a first port and in a second port of the antenna of FIG. 9 by 20 log|S11| (solid) and 20*log|S22| (dashed). FIG. 16 shows transmission between a first port and a second port of the antenna of FIG. 9 by "leakage", 20 log|S12|=20 log|S21|.

Figure 17:
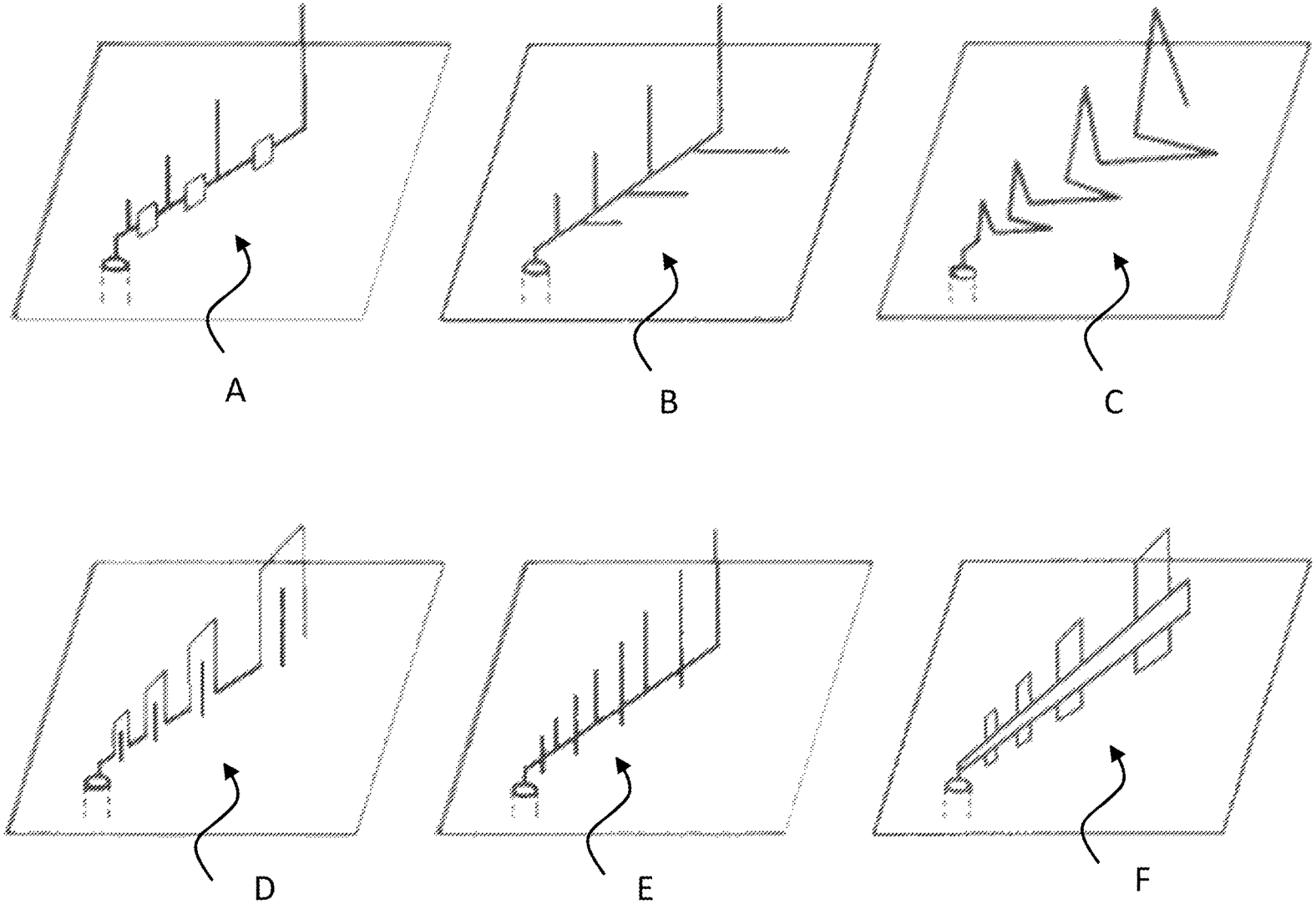
FIG. 17 shows symmetric log-periodic monopole antennas with phase reversal.
Figure 18:
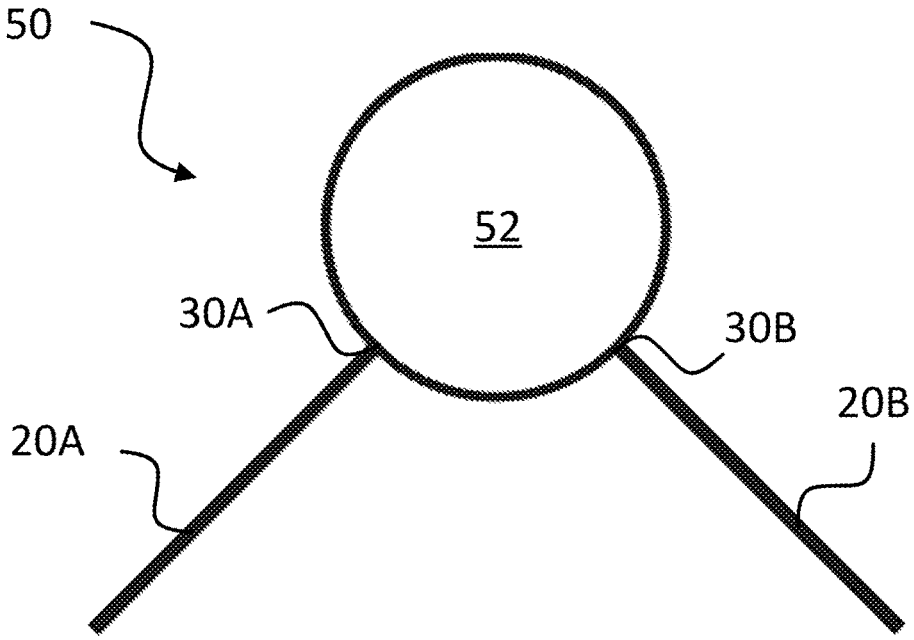
FIG. 18 schematically illustrates an antenna arrangement comprising two antennas being inclined to each other being mounted on an elongated body.

FIG. 17 shows different versions of symmetric single directional log-periodic monopole antennas on a surface constituting a ground plane. All of those versions could be adjusted into a dual directional log-periodic monopole antenna and are covered by this disclosure. The following text is taken from Johnson & Jasik "Antenna Engineering Handbook", Symmetric Log-Periodic Structures, page 14-41-14-42, FIG. 14-36. Many applications require a vertically polarized frequency-independent antenna over the ground plane with a height of about $\lambda/4$ at the low-frequency cut-off. One-half of a symmetric structure can be fed against the ground plane. The problem is how to obtain the extra 180° phase shift between adjacent radiating elements which comes naturally with asymmetric elements. FIG. 17 shows several techniques for accomplishing this, but most are quite sensitive designs. Version A shows an LP monopole array fed by a transmission line over ground. The blocks represent 1:1 transformers with a phase reversal. This is not a sensitive design, but the cost and losses of the transformers may be prohibitive. If the transformers are not included, backfire radiation does not occur in the active region and broadband performance is not obtained. The monopole and zigzag elements may be bent along their centrelines and fed against the ground plane, as illustrated in version B and C. Half the monopole elements act like open-circuited transmission lines whose lengths must be adjusted within a few percent to obtain frequency-independent performance. The shunt transmission lines may be replaced by series LC circuits. The shunt loading produces the extra phase delay required for backfire radiation. The bent zigzag studied by Greiser and Mayes achieves the extra delay by the portions of the line lying over the ground plane. This antenna design is less sensitive than the bent-monopole antenna. Another scheme studied by Greiser is the trapezoidal-type zigzag with parasite monopoles placed as shown in version D. Barbano introduced parasitic monopoles between the elements of a monopole array as illustrated in version E to achieve backfire radiation. The height of the parasitic element is approximately the geometric mean of the adjacent driven-element heights and must be adjusted to within 1 percent of the required height. Another technique devised by Wickersham using capacitive coupling to trapezoidal-sheet monopoles, is shown in version F. FIG. 18 illustrates an antenna arrangement 50 comprising two antennas 20A, 20B being inclined in respect to each other. The antenna arrangement 50 comprises an elongated member 52 and first and second antennas 20A, 20B. Each of the antennas is attached to a respective surface 30A, 30B along the elongated member. Each respective surface is arranged to constitute at least part of the ground plane 30 for the first and second antennas 20A, 20B, respectively, and wherein the antenna elements 13A-K, 23A-F are protruding away from the respective surface, such that the transmission axes 12A, 12B of the first and second antennas 20A, 20B are substantially parallel to each other and such that the antenna elements (13A-K)A, (23A-F)A of the first antenna 20A are protruding in a direction inclined to the antenna elements (13A-K)B, (23A-F)B of the second antenna 20B. In one example, the antenna elements (13A-K)A, (23A-F)A of the first antenna 20A are protruding in a direction substantially orthogonal to the antenna elements (13A-K)B, (23A-F)B of the second antenna 20B.

Figure 19:
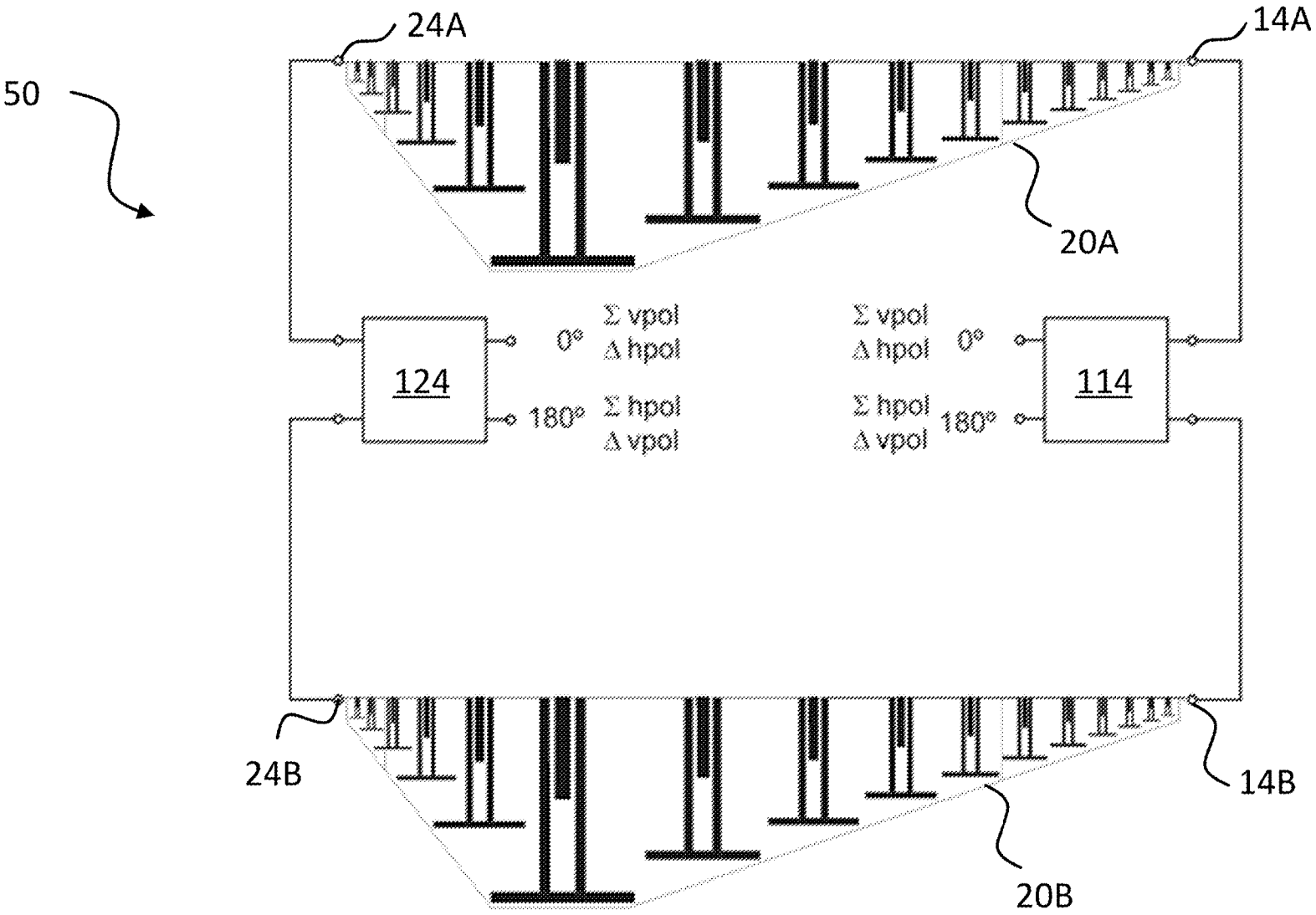
FIG. 19 shows how the ports of the antennas are connected to each other via two 180° hybrids.

FIG. 19 shows how the ports 14A, 24A, 14B, 24B of the antennas 20A, 20B of the antenna arrangement 50 are connected to each other via two 180° hybrids 114, 124. A 180° hybrid often comprises passive components. Each 180° hybrid 114, 124 comprises two input ports and two output ports. When the 180° hybrid 114, 124 is being fed in the port denoted 0°, and the port denoted 180° is terminated (in a matched load), the signal at a given frequency is split equal in amplitude between the remaining two ports and the signals are also in phase. The isolation between the two ports denoted 0° and 180° is high, thus only little current is driven through the matched load. When the 180° hybrid 114, 124 is being fed in the port denoted 180°, and the port denoted 0° is terminated, the signal at a given frequency is also split equal in amplitude between the remaining two ports but the signals are 180° out of phase. The isolation between the two ports denoted 0° and 180° is high, thus only little current is driven through the matched load. The first port 14A, 14B of the respective antenna 20A, 20B are connected to each other via a first 180° hybrid 114, such that each respective first port 14A, 14B can be operated either in phase or 180° out of phase, and the second port 24A, 24B of the respective antenna 20A, 20B are connected to each other via a second 180° hybrid 124, such that each respective second port 24A, 24B can be operated either in phase or 180° out of phase.

Figure 20:
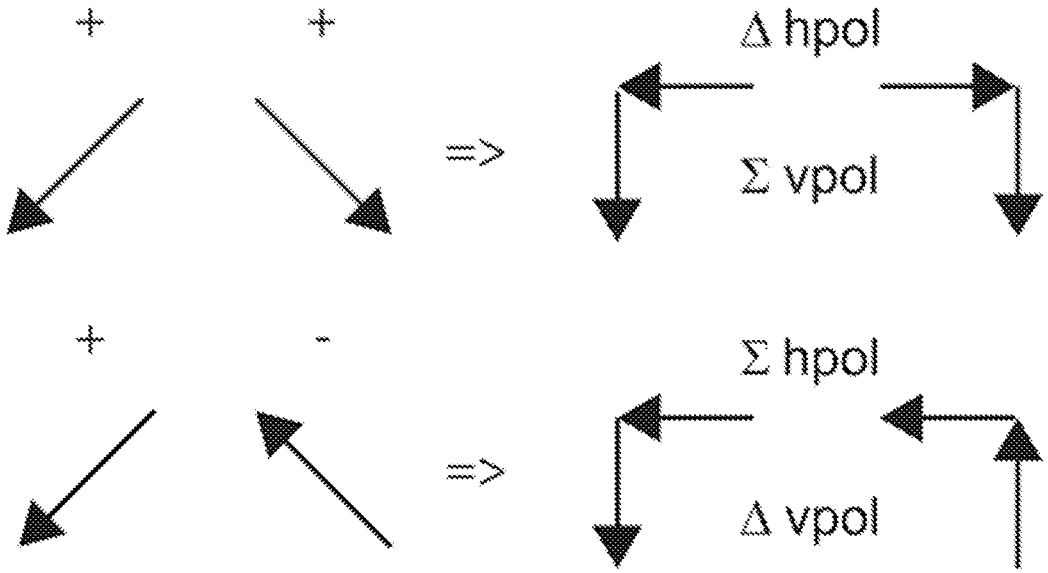
FIG. 20 illustrates how signals from two orthogonal polarized antennas are summed in the forward direction when connected to a 180° hybrid.

FIG. 20 illustrates how signals from two orthogonal polarized antennas are summed in the first (forward) direction 18 or the second (backward) direction 28 when connected to a 180° hybrid. When considering port 0°, a sum type of pattern is obtained for linear vertical polarisation, Σvpol, and a difference type is obtained for horizontal polarisation, Δhpol. When considering port 180°, a difference type of pattern is obtained for vertical polarisation, Δvpol, and a sum type is obtained for horizontal polarisation, Σhpol. Given the four accessible ports of the first and second 180° hybrids 114, 124 in FIG. 19 and given that dual direction log-periodic array antennas 20 are mounted on an elongated object as in FIG. 20, signals received in the four different ports can be combined and processed in different ways to e.g. determine direction of an incoming signal (i.e. for passive direction finding). Typically so called monopulse quotients can be formed using the antennas pointing forward in order to determine the position of an object in a forward sector. The backward pointing antennas can be used to set thresholds and to "block" unwanted signals from entering the system in order to only use monopulse quotients in the angular range of uniqueness. Difference patterns obtained using forward antennas can also be used for this purpose. The prerequisite is that some polarisation discrimination can be made, e.g. linear vertical, linear horizontal or circular. The system can also be used for polarization matched jamming (linear vertical or horizontal) given that some polarization discrimination can be made.

The invention claimed is:

1. An antenna (20; 20'; 20"; 20'"; 20""; 20'""; 200; 200'; 200'–) comprising;

a feed line (11) having a midpoint and first and second ends on opposite sides of the feed line, the feed line (11) being continuous and uninterrupted between the first and second ends, wherein a transmission axis (12) is defined as the axis extending between the first and second ends of the feed line;

a plurality of antenna elements (13A, 13B, 13C . . . ) arranged along the feed line, protruding from the transmission axis;

a first port (14) at the first end of the feed line, wherein, at a first part (15) of the antenna, the feed line, from the first port towards a reference point (16) along the transmission axis and spaced a distance away from the midpoint of the feed line (11), comprises antenna elements (13A, 13B, 13C . . . ) of gradually increasing length, in a direction (17) perpendicular to the transmission axis, and gradually increasing mutual distance between two consecutive antenna elements (13A-13B, 13B-13C . . . ) along the transmission axis, such that the antenna, by means of the antenna elements located at the first part of the antenna, is configured to radiate in a first direction (18) along the transmission axis from the reference point towards the first port during excitation in the first port; and a second port (24) at the second end of the feed line, wherein, at a second part (25) of the antenna, the feed line, from the second port towards the reference point along the transmission axis, comprises antenna elements (23A, 23B, 23C . . . ) of gradually increasing length, in a direction (17) perpendicular to the transmission axis, and gradually increasing mutual distance between two consecutive antenna elements (23A-23B, 23B-23C . . . ) along the transmission axis, such that the antenna, by means of the antenna elements located at the second part of the antenna, is configured to radiate in a second direction (28) along the transmission axis from the reference point towards the second port during excitation in the second port.

2. The antenna according to claim 1, wherein phase reversal (19) is implemented between every two consecutive antenna elements.

3. The antenna according to claim 1, wherein the antenna comprises a ground plane (30) arranged in parallel with the transmission axis and wherein the antenna elements protruding from the transmission axis are protruding away from the ground plane in a direction (17) perpendicular to the ground plane.

4. The antenna according to claim 1, wherein the antenna elements are protruding in a direction (17) perpendicular to the transmission axis.

5. The antenna according to claim 1, wherein each antenna element is formed as a folded antenna element (31) as part of the feed line protruding from the transmission axis.

6. The antenna according to claim 5, wherein each antenna element further comprises a parasitic element (32) protruding from the ground plane into the folded antenna element.

7. The antenna according to claim 1, wherein:

a reference antenna element (13H, 23D) is positioned at the reference point along the transmission axis, belonging to both the first part of the antenna and the second part of the antenna, the reference antenna element is the longest antenna element, the reference antenna element together with the antenna elements located at the first part of the antenna are configured to radiate in the first direction during excitation in the first port, and the reference antenna element together with the antenna elements located at the first part of the antenna are configured radiate in the second direction during excitation in the second port.

8. The antenna according to claim 1, wherein the antenna elements are T-shaped or disc shaped antenna elements (33).

9. The antenna according to claim 1, wherein:

at the first part of the antenna, an imaginary first straight line (34) can be formed between the centre of the top of each antenna element, such that the extension of the imaginary first straight line crosses the extension of the transmission axis at a first vertex (35), and at the second part of the antenna, an imaginary second straight line (44) can be formed between the centre of the top of each antenna element, such that the extension of the imaginary second straight line crosses the extension of the transmission axis at a second vertex (45).

10. The antenna according to claim 9, wherein:

at the first part of the antenna, the relation between the length ( . . . , Li3H, L131, L13J, . . . ) of each antenna element and its distance ( . . . , R13H, R131, Ri3J, . . . ) to the first vertex is constant, and the distance between each consecutive antenna element and the first vertex, starting from the first vertex, increases with a first constant factor $T_I$ ( . . . , R131/R13H/Ri3*j*/Ri3*i*, . . . ) for each consecutive antenna element, and at the second part of the antenna, the relation between the length ( . . . , I-23D/L23E/I-23E, . . . ) of each antenna element and its distance ( . . . , R23D/R23E/R23E/ . . . ) to the second vertex is constant, and the distance between each consecutive antenna element and the second vertex, starting from the second vertex, increases with a second constant factor $t_2$ ( . . . , R23E/R23D/R23F/R23E> . . . ) for each consecutive antenna element.

11. The antenna according to claim 1, wherein each of the first part of the antenna and the second part of the antenna comprises at least three antenna elements.

12. The antenna according to claim 1, wherein each of the antenna elements is a monopole.

13. The antenna according to claim 1, wherein each of the first part and the second part of the antenna is essentially log-periodic.

14. The antenna according to claim 1, wherein each of the first part and the second part of the antenna is a Log-Periodic Folded Monopole Array Antenna, LPFMA.

15. The antenna according to claim 1, wherein the antenna is designed to operate between 0.15 GHz and 1.0 GHz.

16. An antenna arrangement (50) comprising an elongated member (52) and first and second antennas (20A, 20B) according to claim 1, wherein:

each of the antennas is attached to a respective surface (30A, 30B) along the elongated member, wherein each respective surface is arranged to constitute at least part of the ground plane for the first and second antennas, respectively, and the antenna elements are protruding away from the respective surface, such that the transmission axes of the first and second antennas are parallel to each other and such that the antenna elements of the first antenna are protruding in a direction inclined to the antenna elements of the second antenna.

17. The antenna arrangement according to claim 16, wherein:

the first port of the respective antenna (14A, 14B) are connected to each other via a first 180° hybrid (114), such that each respective first port can be operated either in phase or 180° out of phase, and the second port of the respective antenna (24A, 24B) are connected to each other via a second 180° hybrid (124), such that each respective second port can be operated either in phase or 180° out of phase.

18. The antenna according to claim 1, wherein each of the first part of the antenna and the second part of the antenna comprises at least five antenna elements.

19. The antenna according to claim 1, wherein each of the first part of the antenna and the second part of the antenna comprises at least seven antenna elements.

20. An antenna arrangement (50) comprising:

an elongated member (52); and first and second antennas (20A, 20B), each comprising;

a feed line (11) having first and second ends on opposite sides of the feed line, wherein a transmission axis (12) is defined as the axis extending between the first and second ends of the feed line;

a plurality of antenna elements (13A, 13B, 13C . . . ) arranged along the feed line, protruding from the transmission axis;

a first port (14) at the first end of the feed line, wherein, at a first part (15) of the antenna, the feed line, from the first port towards a reference point (16) along the transmission axis, comprises antenna elements (13A, 13B, 13C . . . ) of gradually increasing length, in a direction (17) perpendicular to the transmission axis, and gradually increasing mutual distance between two consecutive antenna elements (13A-13B, 13B-13C . . . ) along the transmission axis, such that the antenna, by means of the antenna elements located at the first part of the antenna, is configured to radiate in a first direction (18) along the transmission axis from the reference point towards the first port during excitation in the first port; and a second port (24) at the second end of the feed line, wherein, at a second part (25) of the antenna, the feed line, from the second port towards the reference point along the transmission axis, comprises antenna elements (23A, 23B, 23C . . . ) of gradually increasing length, in a direction (17) perpendicular to the transmission axis, and gradually increasing mutual distance between two consecutive antenna elements (23A-23B, 23B-23C . . . ) along the transmission axis, such that the antenna, by means of the antenna elements located at the second part of the antenna, is configured to radiate in a second direction (28) along the transmission axis from the reference point towards the second port during excitation in the second port, wherein:

each of the antennas is attached to a respective surface (30A, 30B) along the elongated member, each respective surface is arranged to constitute at least part of the ground plane for the first and second antennas, respectively, the antenna elements are protruding away from the respective surface, such that the transmission axes of the first and second antennas are parallel to each other and such that the antenna elements of the first antenna are protruding in a direction inclined to the antenna elements of the second antenna, the first port of the respective antenna (14A, 14B) are connected to each other via a first 180° hybrid (114), such that each respective first port can be operated either in phase or 180° out of phase, and the second port of the respective antenna (24A, 24B) are connected to each other via a second 180° hybrid (124), such that each respective second port can be operated either in phase or 180° out of phase.

* * * * *